US007930785B2

(12) United States Patent
Cho et al.

(10) Patent No.: US 7,930,785 B2
(45) Date of Patent: Apr. 26, 2011

(54) METHOD FOR CLEANING A TUB IN A WASHING MACHINE AND A WASHING MACHINE PERFORMING THE SAME

(75) Inventors: Han Ki Cho, Changwon-si (KR); Jong Min Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 250 days.

(21) Appl. No.: 11/628,754

(22) PCT Filed: Dec. 22, 2005

(86) PCT No.: PCT/KR2005/004479

§ 371 (c)(1),
(2), (4) Date: Oct. 24, 2008

(87) PCT Pub. No.: WO2007/073012

PCT Pub. Date: Jun. 28, 2007

(65) Prior Publication Data

US 2009/0044834 A1 Feb. 19, 2009

(51) Int. Cl.
*D06F 33/02* (2006.01)

(52) U.S. Cl. ..... 8/158; 68/12.02; 68/207

(58) Field of Classification Search ..... 68/12.02, 68/207

See application file for complete search history.

(56) References Cited

U.S. PATENT DOCUMENTS 3,770,376 A * 11/1973 Sharpe ..... 8/158
4,400,838 A * 8/1983 Steers et al. ..... 8/158
6,463,766 B2 * 10/2002 Kubota et al. ..... 68/12.18
7,171,714 B2 * 2/2007 Pyo et al. ..... 8/159
7,585,374 B2 * 9/2009 Sechelmann ..... 134/18
2006/0151005 A1 * 7/2006 Kim et al. ..... 134/22.1

FOREIGN PATENT DOCUMENTS

CN 1490456 A 4/2004
CN 1566497 A 1/2005
CN 1697897 A 11/2005
DE 19751028 A1 5/1999

(Continued)

OTHER PUBLICATIONS

European Patent Office 1 365 057 Nov. 2003.*

*Primary Examiner* — Frankie L Stinson
(74) *Attorney, Agent, or Firm* — McKenna Long & Aldridge LLP

(57) ABSTRACT

The present invention relates to a method for washing a washing tub and a washing machine having the same applied thereto, and more particularly, a method for washing a washing tub including a detergent removing step, a laundry amount detecting step, and a soaking step; and a washing machine having the same applied thereto. The method includes a detergent removing step for removing detergent from the washing tub, a washing water supply step for supplying washing water to the washing tub, a laundry amount sensing step for sensing a laundry amount in the washing tub for determining whether the method proceeds to the next step or not, a soaking step for soaking dirt on a surface of the washing tub after applying the washing water to the dirt by moving the washing tub, and a washing step for washing the washing tub, if it is determined in the laundry amount sensing step that the method proceeds to the next step.

14 Claims, 5 Drawing Sheets

FOREIGN PATENT DOCUMENTS

| | | | | |
|---|---|---|---|---|
| EP | 0808936 | A2 | | 11/1997 |
| JP | 02-104397 | | * | 4/1990 |
| JP | 04-108494 | | * | 4/1992 |
| JP | 4-218198 | | | 8/1992 |
| JP | 10-099586 | | * | 4/1998 |
| JP | 10-127979 | | | 5/1998 |
| JP | 10-221157 | | * | 8/1998 |
| JP | 2002-018186 | | * | 1/2001 |
| JP | 2002-119789 | | * | 4/2001 |
| JP | 2002-248295 | | | 9/2002 |
| JP | 2004-081508 | | * | 3/2004 |
| JP | 2004-081651 | | | 3/2004 |
| JP | 2004-141344 | | * | 5/2004 |
| JP | 2005-177331 | | * | 7/2005 |
| KR | 2001-101111 | | * | 2/2001 |
| KR | 10-2004-0081590 | | | 9/2004 |
| WO | WO 2005/001189 | | | 1/2005 |

* cited by examiner

METHOD FOR CLEANING A TUB IN A WASHING MACHINE AND A WASHING MACHINE PERFORMING THE SAME

This application claims priority to International application No. PCT/KR2005/004479 filed on Dec. 22, 2005, which is incorporated by reference, as if fully set forth herein.

TECHNICAL FIELD

The present invention relates to a method for washing a washing tub and a washing machine having the same applied thereto, and more particularly, a method for washing a washing tub including a detergent removing step, a laundry amount detecting step, and a soaking step; and a washing machine having the same applied thereto.

BACKGROUND ART

In general, the washing machine washes by using composite action of friction between water circulation and laundry caused by forced circulation of washing water, softening action of detergent, and impact applied to the laundry by a pulsator.

Referring to FIG. 1, such a related art washing machine is provided with a body 10 forming an exterior of the washing machine, an outer tub 20, a washing tub 30 also used as a spinning tub, a pulsator 40, and power transmission means for transmission of power from a motor to the washing tub 30 or the pulsator 40.

The outer tub 20 is suspended in the body, for holding washing water.

The washing tub 30 is rotatably mounted in the outer tub 20 with an appropriate space thereto, and has a plurality of pass through holes 31 for communication with an inside space of the outer tub 20.

The pulsator 40 is rotatably mounted on a center of an inside bottom of the washing tub 30.

The power transmission means is provided with a clutch 50 and a belt 70.

The clutch 50 is fixedly secured to an underside of the outer tub 20, and coupled to the pulsator 40 and the washing tub 30 with a shaft, for rotating the pulsator 40 or the washing tub 30, selectively.

The motor 60 is mounted on one side of an underside of the outer tub 20, for transmission of power to the clutch 50.

In the meantime, on one side of an upper side of the body 10, there is a water supply hose 12 connected thereto, and on one side of the underside of the outer tub 20, there is a drain hose 14 connected thereto for draining washing water.

On top of the body 10 of the washing machine, there is a display window (not shown) for displaying a washing course selected by the user, a washing progressing state, a time period, and the like.

In the washing machine, once a washing mode is selected in a state laundry and detergent is introduced in the washing tub 30, in general, washing, rinsing, and spinning are made automatically according to a control signal from a controller (not shown).

That is, once a washing mode is selected, a water supply valve 11 on the water supply hose is opened, to supply washing water to the washing tub 30 through the water supply hose 11. In this instance, the washing water may be supplied through a powder detergent box, to supply the powder detergent to the washing tub 30, together with the washing water.

In this instance, since the washing tub is in communication with the outer tub 20 through the plurality of pass through holes 31 in the outside circumferential surface, as described before, the washing water supplied to the washing tub 30 is introduced to the outer tub 20 through the pass through holes 31 in the washing tub 30, too.

If the washing water is filled in the outer tub 20 and the washing tub 30 to a certain level by the foregoing process, the water supply valve 11 is closed, to stop the water supply, and the motor 60 fixedly secured to one side of the underside of the outer tub 20 is driven, to drive the clutch, to rotate the washing tub 30 or the pulsator 40 selectively depending on washing cycle.

Accordingly, the laundry in the washing tub 30 is washed by rotation force of the pulsator 40, friction force with an inside circumference of the washing tub 30, and a separative power of the detergent.

Then, when the washing cycle is finished by above actions, the drain valve 13 on the drain hose 14 is opened in response to a control signal from the controller (not shown), the washing water used for the washing is drained from the outer tub 20 and the washing tub 30 to an outside of the body 10 through the drain hose 14.

Thereafter, a rinsing cycle is performed, in which rinsing is repeated a few times in a state washing water is supplied to the washing tub 30. In this instance, since the washing water may be supplied through a bleaching agent box, the bleaching agent may be supplied to the washing tub 30, together with the washing water.

In this instance, the washing machine may also be controlled such that, following draining, short time period of spinning and re-supply of new washing water may be made between rinsing cycles, for improving rinsing efficiency.

Moreover, after such a rinsing cycle is finished fully, a final spinning is performed, when the washing tub 30 and the pulsator 40 are rotated at a high speed in a state the washing water used in the rinsing is naturally drained to an outside of the washing machine.

According to this, water is extracted from the laundry to the outer tub 20 through the pass through holes 31 in the washing tub 30 by centrifugal force caused by the high speed rotation of the washing tub 30 and the pulsator 40.

Moreover, in this instance, since the drain valve 13 under the outer tub 20 is opened, the water from the laundry is drained to an outside of the washing machine through the drain hose 14.

Above spinning cycle is performed for a preset time period, and once the spinning cycle is finished, operation of the washing machine is stopped fully, to finish the washing course.

In the meantime, other than above type and structure of washing machine, there are a so called a tub rotating type of washing machine in which the washing tub 30 rotates in a direction opposite to a rotation direction of the pulsator, and a centrifugal penetration type of washing machine in which the washing is made by water penetrating through the laundry by centrifugal force generated by high speed rotation of the washing machine directly connected to a motor.

Moreover, though not shown, the related art washing machine may be provided with a device for supplying steam to the washing tub during washing or before the washing for soaking the laundry. By supplying hot steam to the laundry, the washing effect is enhanced.

However, regardless of the washing types and structures of above washing machines, there has been a problem in the related art in that dirt from the laundry during washing, and remains and mixtures of detergent and softener remain on inside/outside walls of the washing tub 30, and on an inside wall of the outer tub, to cause re-contamination of the laundry, to drop reliability of the washing machine in view of sanitary.

Moreover, bad odor is produced from microbes, such as fungus on the dirt when the tub is contaminated, to drop reliability of the washing machine in view of sanitary, too.

In general, as the washing machine is used for a long time period, dirt accumulates on the inside/outside surfaces of the washing tub 30 and the inside surface of the outer tub, to increase an amount as time goes by.

In the meantime, though there are washing machines having tub washing functions for resolving problems started from the tub contamination, the present washing machines having the tub washing functions have a poor tub washing efficiency as the tub washing course is progressed, ineffectively.

Particularly, if the washing tub washing is performed in a state the powder detergent is in the washing tub, the powder detergent produces foam, to impede rotation of the washing tub, putting a load on the motor that rotates the washing tub, to cause a power loss.

Moreover, the foam is liable to fail to be discharged with the washing water in draining of water, but stay in the washing tub, to contaminate the washing tub. That is, even if washing of the washing tub is finished, the foam is liable to stay in the washing tub, to contaminate the washing tub.

DISCLOSURE

Technical Problem

An object of the present invention is to solve problems in the related art.

Another object of the present invention is to solve the related art problem of putting an unnecessary load on a motor, which causes a power loss, due to foam from powder detergent at the time of washing of a washing tub.

Another object of the present invention is to solve the problem of the contamination of a washing tub with foam from the powder detergent left in the washing tub even after finish of the washing.

Technical Solution

The washing tub washing of the present invention includes a step for removing detergent from the washing tub for preventing powder detergent from producing foam.

The object of the present invention can be achieved by providing a method for cleaning a washing tub in a washing machine including a detergent removing step for removing detergent from the washing tub, a washing water supply step for supplying washing water to the washing tub, a laundry amount sensing step for sensing a laundry amount in the washing tub for determining whether the method proceeds to the next step or not, a soaking step for soaking dirt on a surface of the washing tub after applying the washing water to the dirt by moving the washing tub, and a washing step for washing the washing tub, if it is determined in the laundry amount sensing step that the method proceeds to the next step.

The detergent removing step may include a washing water supply step for supplying the washing water to the washing tub, and a draining step for draining the washing water. Preferably, the detergent removing step further includes a detergent washing step for moving the washing tub to make the washing water in the washing tub to move for washing the detergent from the washing tub.

Preferably, though the draining step in the detergent removing step may be performed at the same time with, or after the detergent washing step, the draining step may start in the middle of the detergent washing step.

In the detergent washing step, the washing tub may be controlled to make alternate rotation in which the washing tub is rotated in a clockwise direction and an anti-clockwise direction alternately, for moving the washing water therein. The washing tub may be controlled to make one direction, low speed rotation. It is preferable that movement of the washing tub is controlled such that the powder detergent, if any, does not produce foam by the movement of the washing water.

In the detergent washing step, the washing water is moved, to wash the powder detergent which is liable to exist in the washing tub. The detergent in the washing tub is washed as the detergent is dissolved in the washing water, or swept away by moving water.

The soaking step is a step for soaking dirt in the washing tub.

In the soaking step, it is preferable that the washing tub is moved so that the washing water is applied to the dirt on a surface of the washing tub, to enable the washing water to penetrate into the dirt, adequately.

Preferably, the soaking step is performed together with the washing water supply step. By doing this, a total time period required for washing can be reduced. A case is efficient, in which the washing water supplied to the washing tub with the washing water being brought into touch with a wall surface of the washing tub, because the washing water is brought into touch with the surface of the washing tub uniformly as the washing tub is rotated.

The soaking step includes a control step for moving the washing water so that the washing water in the washing tub is applied to the dirt by alternate rotation of the washing tub to rotate the washing tub in a clockwise direction and a counter clockwise direction alternately for moving the washing water to touch to the dirt uniformly.

The soaking step may include a step for rotating the washing tub in one direction at a low speed to move the washing water, for applying the washing water in the washing tub to the dirt.

Preferably, the soaking step further includes a steam supply step for supplying steam to the washing tub. The steam makes effective soaking of the dirt on the surface of the washing tub.

The steam itself has an effect in which the soaking becomes active more than water. Moreover, different from the water, since the steam is gas, the steam diffuses uniformly in the washing tub, to soak even a portion to which the water can not reach.

It is preferable that the washing step is made while the washing tub is rotated at a high speed. If the washing tub is rotated at the high speed, a strong water circulation is formed, which is not only effective to the washing, but also provide a cleaner washing effect as the washing water in the washing tub rotates together with the washing tub to pass through pass through holes in the washing tub by centrifugal force.

In the laundry amount sensing step, a laundry amount in the washing tub is sensed, to determine whether to proceed to the next step or not. Preferably, if it is determined that there is no laundry in the washing tub at all, it is favorable to proceed to the next step. If there is laundry, an unbalance is caused at the time of rotation of the washing tub, to generate noise and vibration.

The laundry amount sensing in the laundry amount sensing step can be made by using RPM ripple of a motor at the time the washing tub is rotated at a constant speed by the motor.

Alternatively, the laundry amount sensing may be made by sensing a water level change of the washing tub in a state the washing tub is stationary. If there is laundry, the water level in the washing tub changes as the laundry wets with water, the existence of laundry can be known by using the water level change.

It is preferable that the method further includes a draining step for draining the washing water from the washing tub after the washing step, a rinsing step for rinsing the washing tub, and a spinning step for rotating the washing tub at a high speed for extracting water after rinsing step.

The steps of the present invention have no specific limitation, and order of performance of the steps may be changed, and, depending on cases, can be performed at the same time. For an example, though the soaking step may be performed after the washing water supply step, the washing water supply step may be performed partly to supply the washing water partly, and rest of the washing water supply step may be performed after the soaking step is performed. Or, the washing water supply step and the soaking step may be performed at the same time.

In another aspect of the present invention, a washing machine having a washing tub washing course provided thereto includes a washing tub, a washing water supply unit for supplying washing water to a washing tub, laundry amount sensing means for sensing a laundry amount in the washing tub, a driving unit for rotating the washing tub, a control panel having washing tub washing course selection means provided thereto for enabling to select a preset washing tub washing course, and a controller for performing the washing tub washing course following selection of the washing tub washing course through the control panel, wherein the washing tub washing course includes a detergent removing step for removing detergent from the washing tub, a washing water supply step for supplying washing water to the washing tub, a laundry amount sensing step for sensing a laundry amount in the washing tub for determining whether the method proceeds to the next step or not, a soaking step for soaking dirt on a surface of the washing tub after applying the washing water to the dirt by moving the washing tub, and a washing step for washing the washing tub, if it is determined in the laundry amount sensing step that the method proceeds to the next step.

ADVANTAGEOUS EFFECTS

The washing method of the present invention solves the problem of power loss taken place as the powder detergent produces foam in the related art washing tub washing which puts a load on the motor.

Moreover, the washing method of the present invention solves the problem of contamination of the washing tub with foam from the powder detergent remained in the washing tub even after the washing is finished.

The washing method of the present invention solves the problems of re-contamination of the laundry caused by the contamination of the washing tub, and production of odor by microbes, such as fungi at the contaminant.

Moreover, the washing machine of the present invention enables to provide a cleaning performance better than the related art washing machine in view of hygiene, and prevent a washing performance in washing from dropping in advance, to enhance reliability of the washing machine.

BEST MODE

Figure 1:
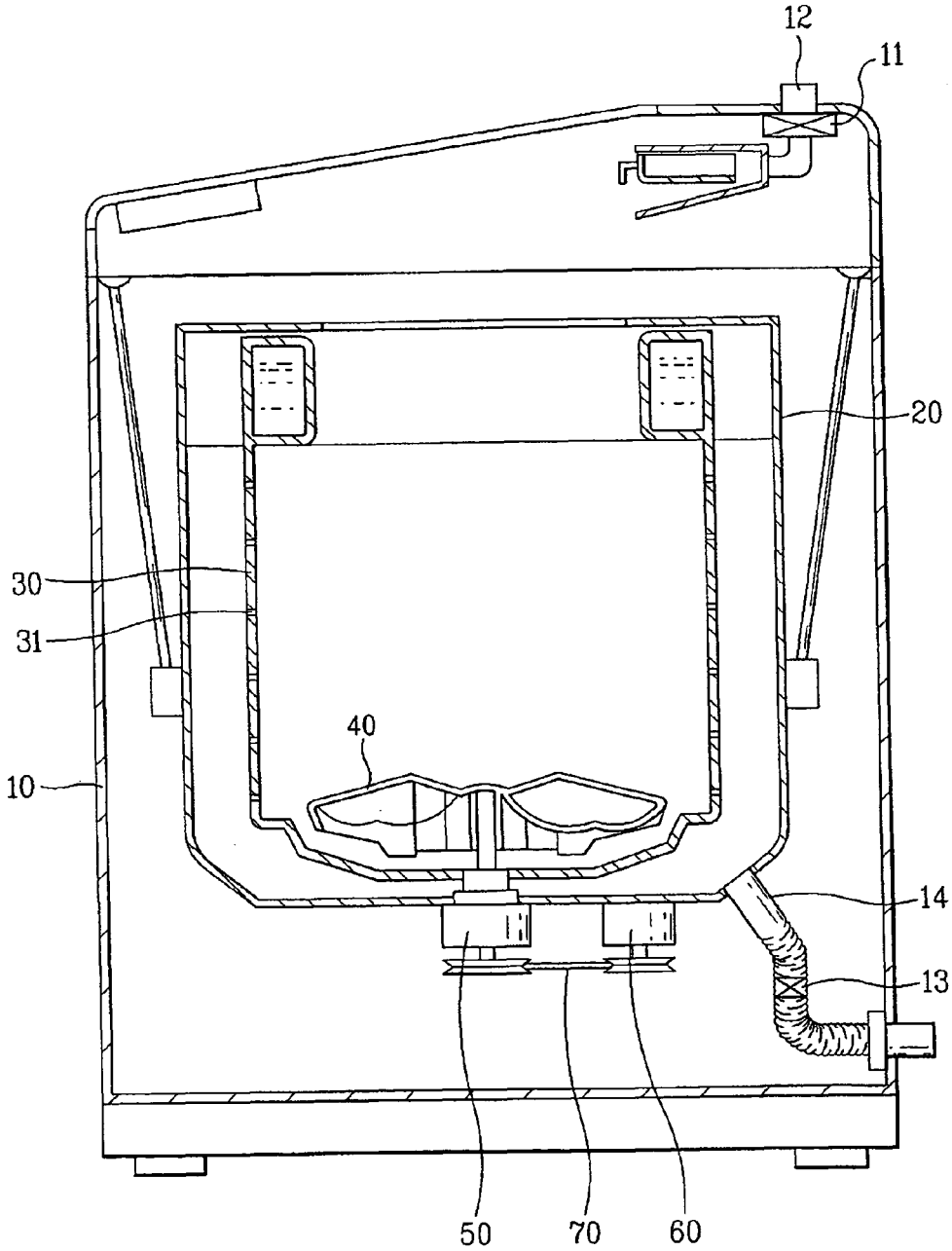
FIG. 1 Prior Art
FIG. 1 illustrates a related art washing machine.
Figure 2:
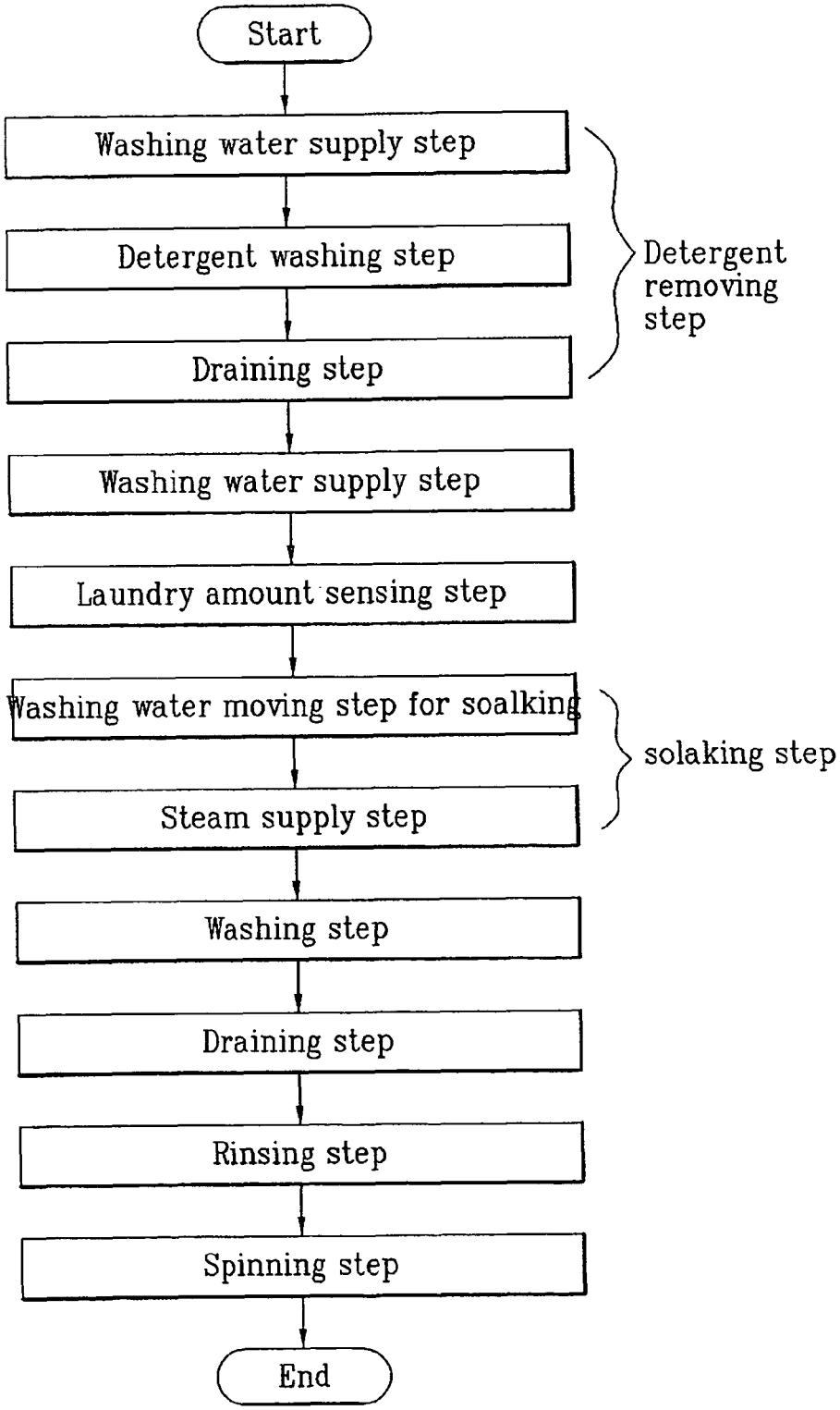
FIG. 2 illustrates a flow chart showing the steps of a method for washing a washing tub in accordance with a preferred embodiment of the present invention.

FIG. 2 illustrates a flow chart showing the steps of a method for cleaning a washing tub in accordance with a preferred embodiment of the present invention, including a detergent removing step, a washing water supply step, a laundry amount sensing step, a soaking step, a washing step, a washing water draining step, a rinsing step, and a spinning step.

The detergent removing step includes a washing water supply step for supplying washing water, a detergent washing step for washing powder detergent from a surface of the washing tub, and a draining step for draining water.

Figure 3:
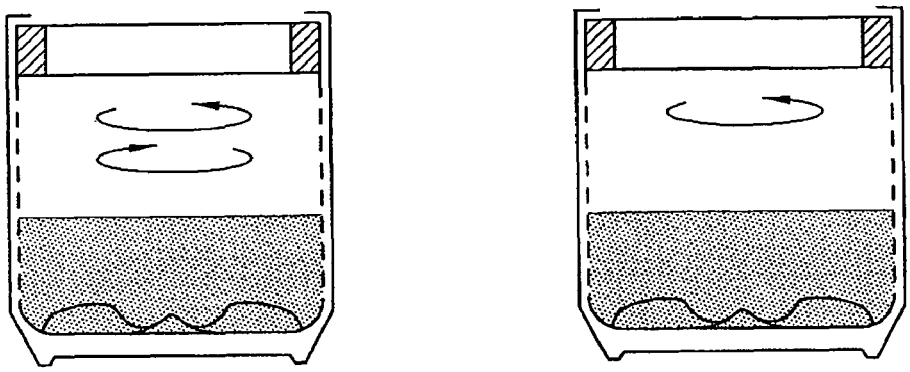
FIG. 3 illustrates forms of rotation of the washing tub.

Referring to FIG. 3, in the detergent washing step, the washing tub may rotate alternately in the clockwise direction and the counter clockwise direction, or only in one direction, or compositely in which the alternate rotation and one directional rotate take place in a combination. It is preferable that the washing tub is rotated at a low speed, because high speed rotation of the washing tub is likely to produce much foam from the powder detergent.

If there is the powder detergent in the washing tub in any reason, it is necessary to remove the powder detergent at first because the powder detergent produces foam during washing to the washing tub. In the detergent removing step, the powder detergent that can exist in the washing tub is removed.

In the detergent removing step, the washing water supply step, the detergent washing step, and the draining step can be performed at the same time, or the washing water supply step, and the detergent washing step may be started at first, and the draining step may be performed during progress of the washing water supply step, and the detergent washing step. Besides these, two of the washing water supply step, the detergent washing step, and the draining step may be performed at the same time, or one after the other as far as a detergent removing effect can be obtained.

If the detergent washing step is finished, the washing waster supply step is performed for supplying washing water for main washing. The laundry amount sensing step is performed for sensing a laundry amount in the washing tub to determine whether to proceed to the next step of not in a state required washing water is supplied partly, or fully. In a case the washing water is supplied only partly in the washing water supply step, rest of the washing water is supplied after the laundry amount sensing step is finished, to finish the washing water supply step.

Figure 4:
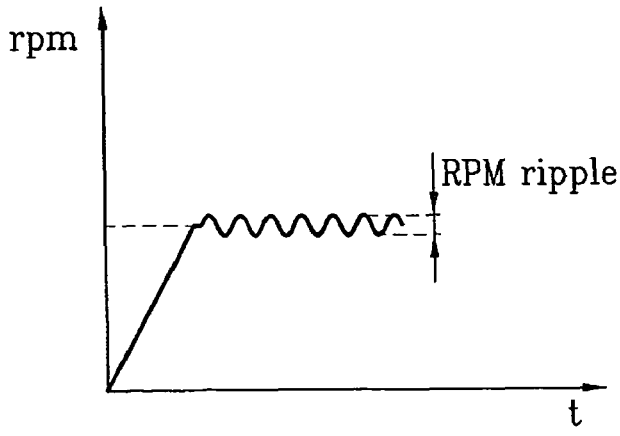
FIG. 4 illustrates a graph showing RPM of a motor at the time of constant speed rotation of a washing tub.

FIG. 4 illustrates a graph showing RPM of a motor at the time of constant speed rotation of a washing tub. Laundry in the washing tub causes unbalance to vary RPM of the motor, utilizing which existence of laundry in the washing tub can be detected.

Referring to FIG. 4, if the washing tub is controlled to be rotated at a constant speed, RPM of the motor ripples. The laundry amount is sensed by using the RPM ripple.

Figure 5:
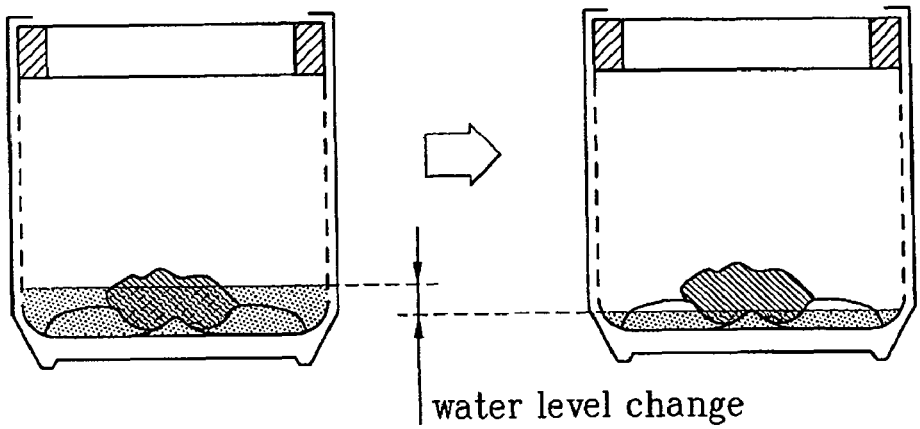
FIG. 5 illustrates a water level change when laundry is in a washing tub.

FIG. 5 illustrates a water level change when laundry is in a washing tub. The laundry in the washing tub absorbs water, to change the water level in the washing tub, by using which the laundry amount can be sensed. The water level change can be sensed by using a flow meter.

It is adequate that the laundry amount sensing step is performed before starting the washing step intrinsically, and it is not required that the laundry amount sensing step is performed before, or after other steps necessarily. However, it is preferable that the laundry amount sensing step is performed at an early stage as far as possible once the user selects a washing course of the washing tub.

If it is known that there is no laundry in the washing tub in the laundry amount sensing step, the method proceeds to the soaking step.

The soaking step requires an appropriate time period for the water to penetrate into the dirt on a surface of the washing tub.

In the soaking step, the washing tub may rotate in fashions as shown in FIG. 3. Such rotation of washing tub makes the washing water to circulate to apply the washing water to the surface of the washing tub, uniformly. Preferably, the washing tub rotates in a clockwise direction for 10 seconds, pauses for 20 seconds, and rotates in a counter clockwise direction for 10 seconds. In the soaking step, the rotation speed of the washing tub is required to be high not necessarily, but to make the washing water to reach to an upper surface of the washing tub.

Upon finishing the step of rotating the washing tub to circulate the washing water, the steam supply step is performed, in which steam is supplied to the washing tub.

It is preferable that a certain time period is waited after steam is supplied, until water or steam penetrates into dirt, to make the soaking action, well.

When the soaking is finished, the method proceeds to the washing step in which a main washing is performed.

In the washing step, the washing tub is rotated at a high speed for forming a strong water circulation, to make an effective washing action.

If the washing tub rotates at the high speed, the washing water spouts from the washing tub through the pass through holes by centrifugal force, making the washing water circulate quickly, thereby washing the washing tub, more effectively.

In the washing step, the washing tub rotates in the clockwise direction for 120 seconds, pauses for about 20 seconds, and rotates again in the counter clockwise direction for about 120 seconds. Above steps are repeated for a few times.

If the washing step is finished, the draining step is performed, in which the washing water is drained from the washing tub.

After the draining step, the rinsing step is performed, in which the washing tub is rinsed, and drained while the washing water is supplied. The draining step and the rinsing step may be made at the same time.

If the rinsing step is finished, the spinning step is performed, in which the washing tub is rotated at a high speed for removing water from the washing tub.

In the meantime, the washing machine having the method for washing a washing tub applied thereto in accordance with a preferred embodiment of the present invention includes the method programmed at the controller as a washing tub washing course. Accordingly, if the user selects the washing tub washing course, the method for washing a washing tub in FIG. 2 is performed, automatically.

Because the method for washing a washing tub in FIG. 2 is described, and embodying the washing machine by programming the method in FIG. 2 at the controller is easy to a person skilled in the field, no more detailed description will be given.

MODE FOR INVENTION

In a method for washing a washing tub in accordance with another preferred embodiment of the present invention, the detergent removing step in FIG. 2 is embodied differently.

Figure 6:
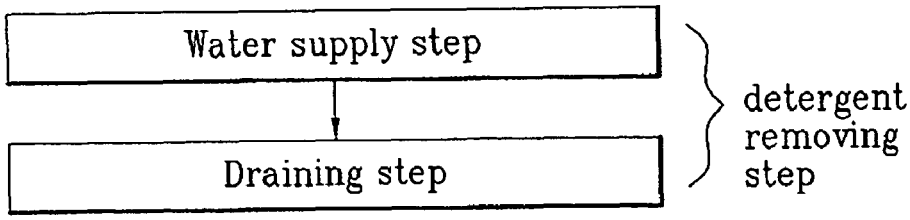
FIG. 6 illustrates a flow chart showing the step for removing detergent in accordance with another preferred embodiment of the present invention.

That is, referring to FIG. 6, the detergent removing step includes a washing water supply step and a draining step. If the washing water is supplied through the powder detergent box, it is required that the powder detergent is drained as it is, for preventing the powder detergent from remaining in the washing tub by the washing water supply and the draining. The washing water supply step and the draining step may be performed at the same time.

Figure 7:
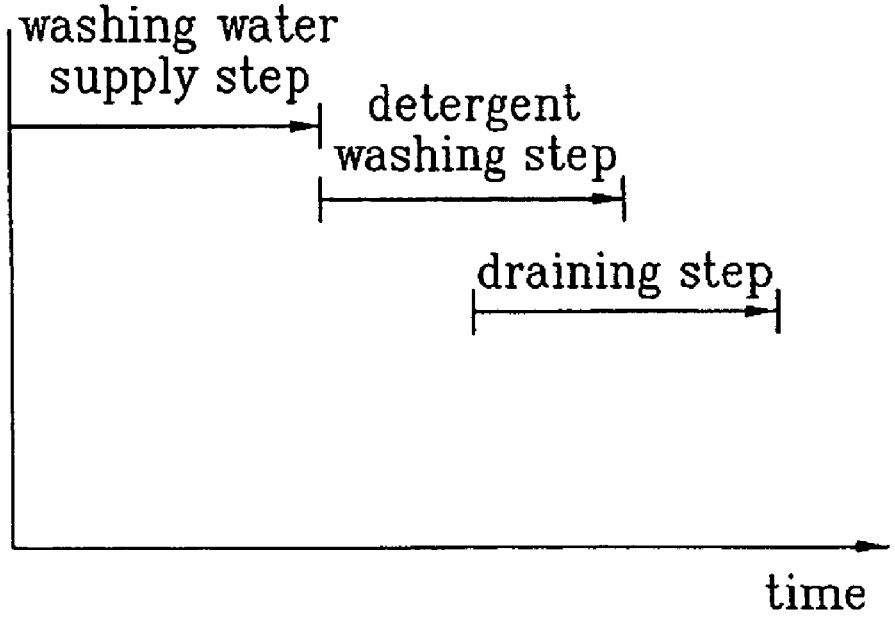
FIG. 7 illustrates a flow chart showing the step for removing detergent in accordance with another preferred embodiment of the present invention.

Moreover, referring to FIG. 7, in a method for washing a washing tub in accordance with another preferred embodiment of the present invention, the detergent removing step includes a washing water supply step, a detergent washing step, and draining step, wherein the draining step is started in the middle of the detergent washing step. That is, draining is made while the detergent is washed from the washing tub.

INDUSTRIAL APPLICABILITY

The present invention relates to a method for washing a washing tub and a washing machine having the same applied thereto, and more particularly, a method for washing a washing tub including a detergent removing step, a laundry amount detecting step, and a soaking step; and a washing machine having the same applied thereto.

The washing method of the present invention solves the problem of power loss taken place as the powder detergent produces foam in the related art washing tub washing which puts a load on the motor.

Moreover, the washing method of the present invention solves the problem of contamination of the washing tub with foam from the powder detergent remained in the washing tub even after the washing is finished.

The washing method of the present invention solves the problems of re-contamination of the laundry caused by the contamination of the washing tub, and production of odor by microbes, such as fungi at the contaminant.

Moreover, the washing machine of the present invention enables to provide a cleaning performance better than the related art washing machine in view of hygiene, and prevent a washing performance in washing from dropping in advance, to enhance reliability of the washing machine.

The invention claimed is:

1. A method for cleaning a washing tub in a washing machine comprising:

a detergent removing step for removing detergent from the washing tub;

a washing water supply step for supplying washing water to the washing tub;

a laundry amount sensing step for sensing a laundry amount in the washing tub for determining whether to proceed to a next step or not;

a soaking step for soaking dirt on a surface of the washing tub after applying the washing water to the dirt by moving the washing tub; and a washing step for washing the washing tub, if it is determined to proceed to the next step in the laundry amount sensing step, wherein the detergent removing step comprises:

a washing water supply step for supplying the washing water to the washing tub;

a detergent washing step for moving the washing tub to make the washing water in the washing tub to move for washing the detergent from the washing tub; and a draining step for draining the washing water, wherein the draining step in the detergent removing step starts in the middle of the detergent washing step.

2. The method as claimed in claim 1, wherein the moving of the washing tub in the detergent washing step is made by alternate rotation in which the washing tub is rotated in a clockwise direction and an anti-clockwise direction, alternately.

3. The method as claimed in claim 1, wherein the moving of the washing tub in the detergent washing step is made by one directional low speed rotation of the washing tub.

4. The method as claimed in claim 1, wherein the soaking step comprises;

a step for moving the washing water so that the washing water in the washing tub is applied to the dirt by alternate rotation of the washing tub to rotate the washing tub in a clockwise direction and a counter clockwise direction, alternately.

5. The method as claimed in claim 4, wherein the soaking step further comprises a steam supply step for supplying steam to the washing tub.

6. The method as claimed in claim 5, wherein the detergent removing step further comprises a detergent washing step for moving the washing tub to make the washing water in the washing tub to move for washing the detergent from the washing tub.

7. The method as claimed in claim 1, wherein the soaking step comprises a step for rotating the washing tub in one direction at a low speed to move the washing water, for applying the washing water in the washing tub to the dirt.

8. The method as claimed in claim 1, wherein the washing step comprises a step of rotating the washing tub at a high speed.

9. The method as claimed in claim 1, further comprising:

a draining step for draining the washing water from the washing tub after the washing step, a rinsing step for rinsing the washing tub, and a spinning step for rotating the washing tub at a high speed for extracting water after rinsing step.

10. The method as claimed in claim 1, wherein the laundry amount sensing step comprises a step of using RPM ripple of a motor which rotates the washing tub at the time of constant speed rotation of the washing tub.

11. The method as claimed in claim 1, wherein the laundry amount sensing step comprises a step of sensing a water level change of the washing water in the washing tub in a state the washing tub is stationary.

12. A washing machine having a washing tub washing course provided thereto comprising:

a washing tub;

a washing water supply unit for supplying washing water to a washing tub;

laundry amount sensing means for sensing a laundry amount in the washing tub;

a driving unit for rotating the washing tub;

a control panel having washing tub washing course selection means provided thereto for enabling to select a preset washing tub washing course; and a controller for performing the washing tub washing course following selection of the washing tub washing course through the control panel, wherein the washing tub washing course comprises:

a detergent removing step for removing detergent from the washing tub, the detergent removing step comprises:

a washing water supply step for supplying the washing water to the washing tub;

a detergent washing step for moving the washing tub to make the washing water in the washing tub to move for washing the detergent from the washing tub; and a draining step for draining the washing water, wherein the draining step in the detergent removing step starts in the middle of the detergent washing step;

a washing water supply step for supplying washing water to the washing tub;

a laundry amount sensing step for sensing a laundry amount in the washing tub for determining whether to proceed to a next step or not;

a soaking step for soaking dirt on a surface of the washing tub after applying the washing water to the dirt by moving the washing tub; and a washing step for washing the washing tub, if it is determined to proceed to the next step in the laundry amount sensing step.

13. The method washing machine as claimed in claim 12, wherein the moving of the washing tub in the detergent washing step is made by alternate rotation in which the washing tub is rotated in a clockwise direction and an anti-clockwise direction, alternately.

14. The method washing machine as claimed in claim 12, wherein the moving of the washing tub in the detergent washing step is made by one directional low speed rotation of the washing tub.

* * * * *